US007918447B2

(12) United States Patent
One

(10) Patent No.: US 7,918,447 B2
(45) Date of Patent: Apr. 5, 2011

(54) IMAGE FORMING APPARATUS

(75) Inventor: Jae Yoon One, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/494,825

(22) Filed: Jun. 30, 2009

(65) Prior Publication Data

US 2010/0044951 A1 Feb. 25, 2010

(30) Foreign Application Priority Data

Aug. 22, 2008 (KR) ..... 10-2008-0082342

(51) Int. Cl.
*B65H 1/00* (2006.01)

(52) U.S. Cl. ..... 271/145; 271/109

(58) Field of Classification Search ..... 271/109, 271/10.11, 208, 145
See application file for complete search history.

(56) References Cited

U.S. PATENT DOCUMENTS 6,155,557 A * 12/2000 Suzuki ..... 271/119
7,641,188 B2 * 1/2010 Hiura et al. ..... 271/122

FOREIGN PATENT DOCUMENTS

KR 10-2006-0076572 7/2006

OTHER PUBLICATIONS

English language abstract of KR 10-2006-0076572, published Jul. 4, 2006.

* cited by examiner

*Primary Examiner* — Kaitlin S Joerger
(74) *Attorney, Agent, or Firm* — Stanzione & Kim, LLP

(57) ABSTRACT

An inkjet image forming apparatus including a printing media storage unit configured to store printing media, a pickup unit configured to pick up a printing medium stored in the printing media storage unit, and a cover made of a conductive material and adapted to come into contact with the printing medium picked up by the pickup unit. An effective removal of static charge from the printing medium is possible by having the printing medium picked up by the pickup unit come into contact with the cover.

17 Claims, 4 Drawing Sheets

IMAGE FORMING APPARATUS

CROSS-REFERENCE TO RELATED APPLICATIONS

This application claims the benefit of Korean Patent Application No. 2008-0082342, filed on Aug. 22, 2008 in the Korean Intellectual Property Office, the disclosure of which is incorporated herein by reference in its entirety.

TECHNICAL FIELD

The present invention relates to an image forming apparatus, and, more particularly, to an image forming apparatus configured to reduce static charge generated when a printing medium is picked up.

BACKGROUND OF RELATED ART

An image forming apparatus is an apparatus that is used to form an image on a printing medium according to input image signals. Examples of image forming apparatuses include printers, copiers, facsimiles, and devices that combine the functions of one or more of such apparatuses.

An image forming apparatus typically includes a body that defines the external appearance of the apparatus, a printing media storage unit in which one or more sheets of printing media (e.g., sheets of printing paper) can be stored, a developing unit that forms a toner image on a printing medium, a pickup unit that picks up a printing medium from the printing media storage unit, and that feeds the picked-up printing medium to the developing unit, a fixing unit that fixes the toner image to the printing medium, and a discharge unit that discharges the printing medium, on which an image has been formed, out of the body of the image processing apparatus.

In an image forming apparatus having the above-described configuration, an electrostatic latent image is formed on a surface of a photoconductor of the developing unit by irradiating light on the surface of the photoconductor that had been charged with a predetermined electric potential. After being formed on the photoconductor, the electrostatic latent image is developed with toner to form a visible toner image. The toner image on the photoconductor is transferred to a printing medium fed from the printing media storage unit by the pickup unit. The toner image is fixed to the printing medium while passing the printing medium through the fixing unit such that the image is completely formed on the printing medium. The printing medium having the formed image is discharged out of the body of the image forming apparatus via the discharge unit.

When the printing medium is picked up from the printing media storage unit by the pickup unit to be delivered to the developing unit as described above, the picked-up printing medium can accumulate static charge by the friction that occurs between the picked-up printing medium and printing medium remaining in the printing media storage unit. The static charge can have negative effects on the operation of various elements of the image forming apparatus. Therefore, an image forming apparatus having a configuration that can reduce the amount of static charge is desirable.

SUMMARY OF THE DISCLOSURE

In accordance with one aspect of various embodiments of the disclosure, there is provided an image forming apparatus including a printing media storage unit configured to store printing media, a pickup unit configured to pick up a printing medium from the printing media stored in the printing media storage unit, and a cover made of a conductive material and adapted to come into contact with the printing medium picked up by the pickup unit.

The cover can include a protrusion configured to come into contact with the printing medium. The protrusion of the cover can have a curved portion that comes into contact with the printing medium.

The pickup unit can include a pickup roller having a portion of its circumferential region radially protruding to form a pickup portion, and the protrusion of the cover can be located in an axial direction of the pickup roller at a pickup position where the pickup portion of the pickup roller comes into contact with the printing medium.

The pickup unit can include a printing media detection sensor configured to sense the presence of the printing media in the printing media storage unit. The printing media detection sensor can include an actuator and a sensing unit. The actuator can be configured to be moved according to an amount of the printing media in the printing media storage unit and the sensing unit can be configured to sense a position of the actuator. The cover can be positioned to cover the sensing unit.

The pickup unit can include a printing media detection sensor configured to sense the presence of the printing media in the printing media storage unit. The printing media detection sensor can include an actuator and a sensing unit. The actuator can be configured to be moved according to an amount of the printing media in the printing media storage unit and the sensing unit can be configured to sense a position of the actuator. The cover can be configured to limit a movement of the actuator.

The apparatus can further include a feed roller configured to move the printing medium picked up by the pickup unit, and a feed shaft configured to transfer a rotating force to the feed roller. The actuator of the printing media detection sensor can have one end rotatably coupled to the feed shaft.

The apparatus can further include an antistatic brush coupled to the cover and configured to come into contact with the printing medium.

The cover of the apparatus can be grounded.

In accordance with another aspect of the various embodiments of the disclosure, there is provided an image forming apparatus including a printing media storage unit configured to store printing media, a pickup unit including a pickup roller, the pick up unit configured to pick up a printing medium from the printing media stored in the printing media storage unit, and a cover made of a conductive material and arranged substantially parallel to the pickup roller in an axial direction of the pickup roller.

In accordance with a further aspect of various embodiments of the disclosure, there is provided an image forming apparatus including a printing media storage unit configured to store printing media, a pickup unit configured to pick up a printing medium from the printing media stored in the printing media storage unit, a printing media detection sensor configured to sense the presence of the printing media in the printing media storage unit, and a cover configured to cover the printing media detection sensor. The cover can be made of a conductive material and can be grounded. The cover can include a protrusion configured to come into contact with the printing medium picked up by the pickup unit.

BRIEF DESCRIPTION OF THE DRAWINGS

These and/or other aspects and advantages of the present disclosure will become apparent and more readily appreciated from the following description of the embodiments, taken in conjunction with the accompanying drawings, in which.

DETAILED DESCRIPTION OF SEVERAL EMBODIMENTS

Figure 1:
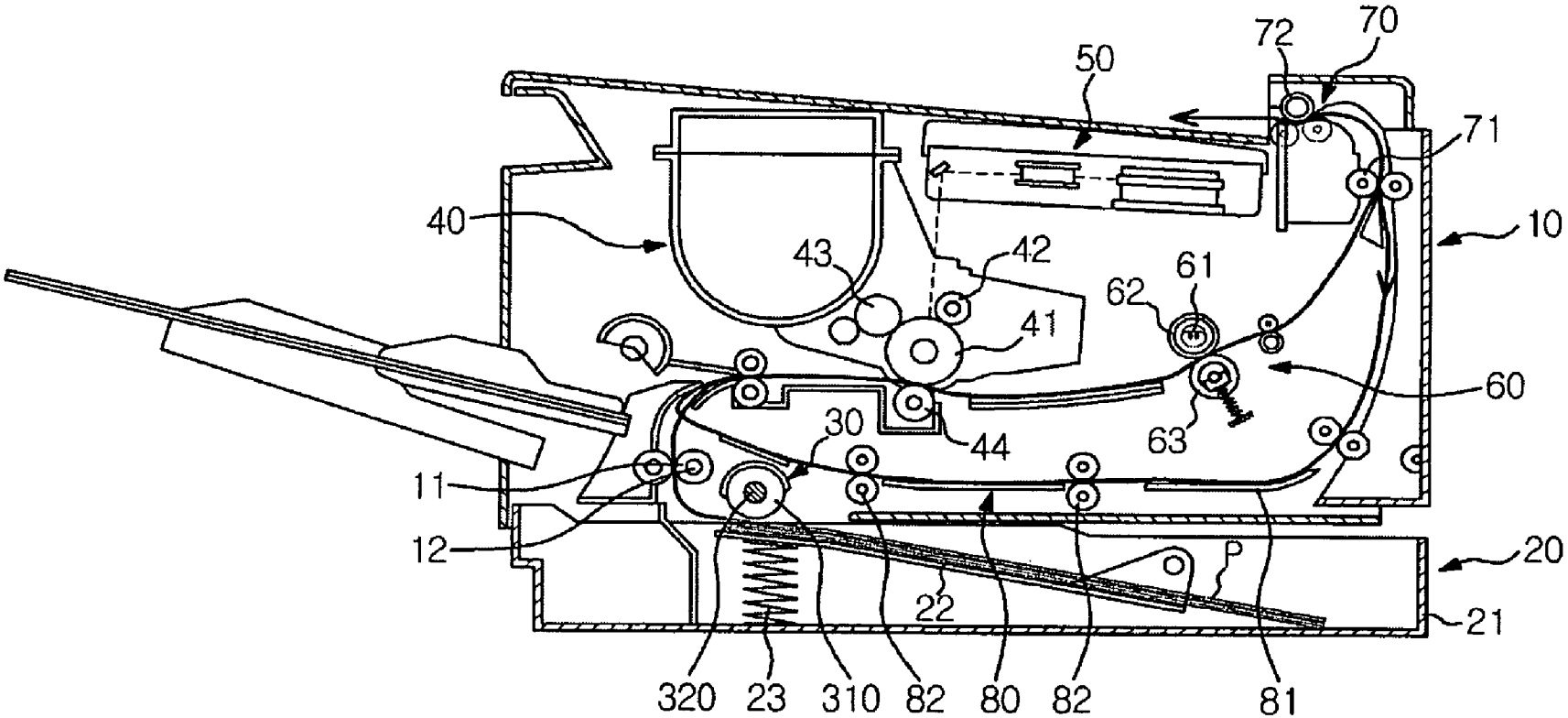
FIG. 1 is a sectional view illustrating a schematic configuration of an image forming apparatus according to an embodiment of the disclosure.

Reference will now be made in detail to various embodiments, examples of which are illustrated in the accompanying drawings, wherein like reference numerals refer to the like elements throughout. The embodiments are described below by referring to the figures.

As shown in FIG. 1, an image forming apparatus according to an exemplary embodiment includes a body 10, a printing media storage unit 20, a pickup unit 30, a developing unit 40, an exposure unit 50, a fixing unit 60, a discharge unit 70 and a duplex unit 80. The body 10 defines the external appearance of the apparatus. The printing media storage unit 20 is configured to store printing media, such as one or more printing medium P. The printing media storage unit 20 is configured to feed the printing medium P to the developing unit 40. The pickup unit 30 is configured to pick up a printing medium P from the printed media stored in the printing media storage unit 20. The developing unit 40 is configured to form a toner image on the printing medium P fed by the pickup unit 30. The exposure unit 50 is configured to form an electrostatic latent image on a photoconductor 41 of the developing unit 40. The fixing unit 60 is configured to fix a toner image onto the printing medium P. The discharge unit 70 is configured to discharge the printing medium P, on which an image has been formed, out of the body 10 of the image forming apparatus. The duplex unit 80 is configured to return the printing medium P, having an image formed on one surface, to the developing unit 40 for further printing on the other surface of the printing medium P.

The printing media storage unit 20 can include a printing media cassette 21, of a drawer type, for example, detachably fitted in the body 10, and a knock-up plate 22 disposed in the printing media cassette 21 to support printing media (e.g., one or more printing medium P) stacked thereon. The knock-up plate 22 can have one end pivotally secured to an inner portion of the printing media cassette 21 and the other end elastically supported by an elastic member 23 (e.g., a spring) such that the knock-up plate 22 is pivotally rotatable about the secured end by the elastic effect of the elastic member 23.

The developing unit 40 is configured to form a toner image on the printing medium P delivered or transferred from the printing media storage unit 20. The developing unit 40 can include the photoconductor 41. An electrostatic latent image can be formed on a surface of the photoconductor 41 by the exposure unit 50. The developing unit 40 can also include a charge roller 42 configured to electrically charge the photoconductor 41, a developing roller 43 configured to develop the electrostatic latent image formed on the photoconductor 41 into the toner image, and a transfer roller 44 configured to press the printing medium P against the photoconductor 41 such that the toner image on the photoconductor 41 is transferred to the printing medium P.

The exposure unit 50 is configured to irradiate electromagnetic radiation (e.g. light) containing image information to the photoconductor 41 to form the electrostatic latent image on the surface of the photoconductor 41.

The fixing unit 60 is configured to apply heat and pressure to the printing medium P to fix or impress the toner image onto the printing medium P. The fixing unit 60 can include a heating roller 62 having a heater 61 and a press roller 63 configured to press or push the printing medium P against the heating roller 62. By exposing the printing medium P to heat and pressure while passing the printing medium P through a gap between the heating roller 62 and the press roller 63, the toner image on the printing medium P is thereby fixed to the printing medium P.

The discharge unit 70 can include a first discharge roller 71 and a second discharge roller 72 arranged in sequence and configured to discharge the printing medium P out of the body 10 after the printing premium P has passed through the fixing unit 60.

The duplex unit 80 is configured to return the printing medium P, one surface of which has an image formed, to the developing unit 40 to print an image on the other surface of the printing medium P. The duplex unit 80 can include a double-sided printing guide 81 that defines a return path for the printing medium P and a series of return rollers 82 arranged on the return path to deliver the printing medium P to the developing unit 40 for further printing. During double-sided printing, the printing medium P, which has one surface with a formed image, is discharged by the second discharge roller 72 and is returned at a specific instance in time to be guided to the double-sided guide 81. The printing medium P is returned to the developing unit 40 by the return rollers 82 and is passed through the developing unit 40 and the fixing unit 60, allowing an image to be formed on the other surface of the printing medium P.

Figure 2:
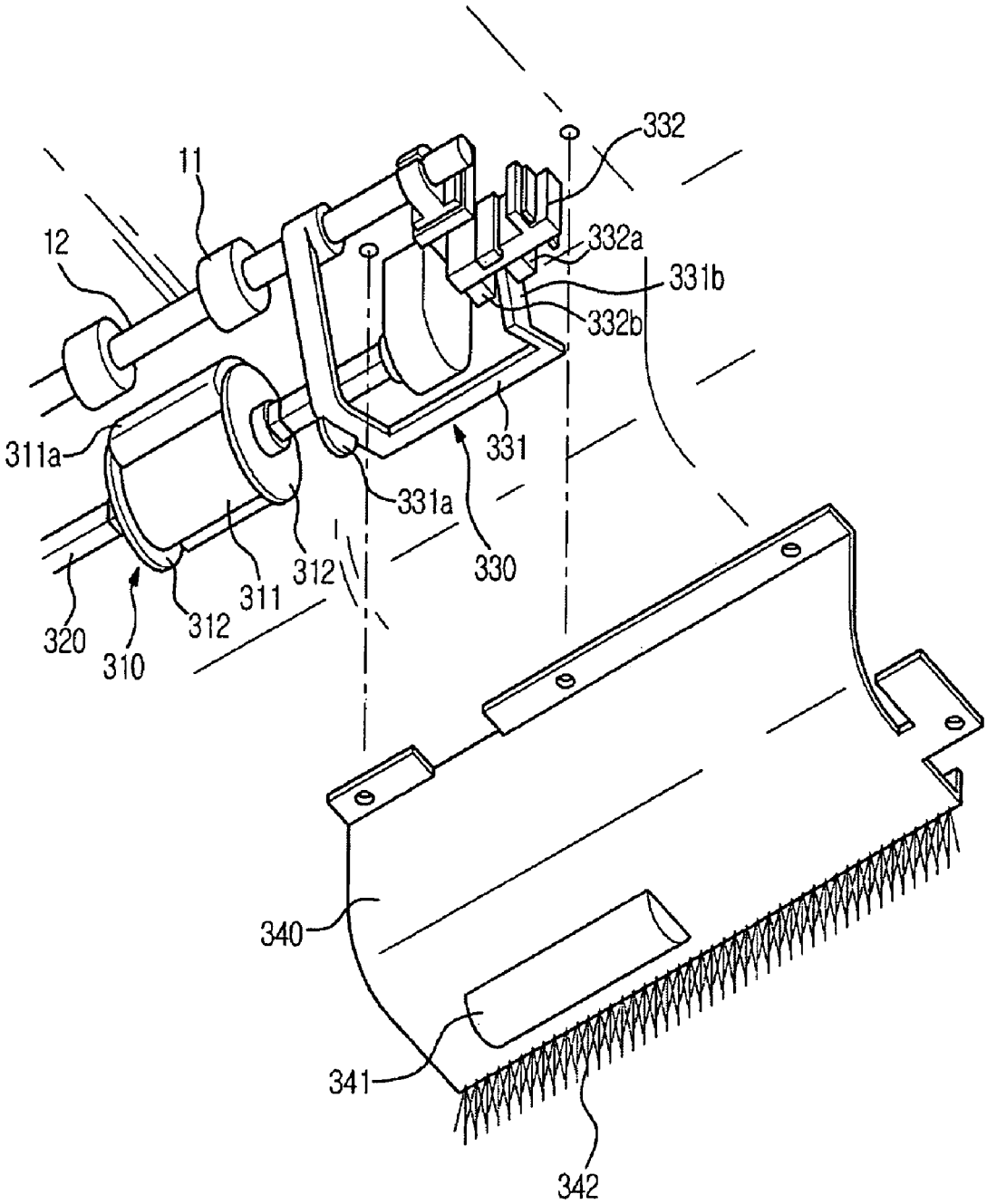
FIG. 2 is a perspective view illustrating a pickup unit provided in the image forming apparatus according to an embodiment of the disclosure.

FIG. 2 shows the pickup unit 30, which is configured to pick up the printing medium P by, for example, picking up the uppermost sheet from one or more sheets of printing media stored in the printing media storage unit 20. The pickup unit 30 is configured to deliver or transfer the printing medium P to the developing unit 40. The pickup unit 30 can include a pickup roller 310 configured to pick up the printing medium P from the printed media stored in the printing media storage unit 20 by friction that occurs when the printing medium P contacts the rotating pickup roller 310. The pickup unit 30 can also include a pickup shaft 320 to transfer a rotating force to the pickup roller 310 to rotate the pickup roller 310. The pickup roller 310 can include a pickup rotor 311 configured to pick up the printing medium P stacked on the knock-up plate 22, and a pair of idle rollers 312 rotatably disposed at opposite sides of the pickup rotor 311. In one embodiment, a portion of the outer circumference of the pickup rotor 311 can radially protrude outward of the idle rollers 312 to form a pickup portion 311*a*. The pickup portion 311*a* is configured to come into contact with the printing medium P stacked on the knock-up plate 22. Accordingly, after the pickup portion 311*a* of the pickup rotor 311 reaches a pickup position in which the pickup portion 311*a* can come into contact with the printing medium P stacked on the knock-up plate 22 via rotation of the pickup roller 310, the printing medium P is picked up by a frictional force caused between the pickup portion 311*a* and the printing medium P. The printing medium P is delivered to the developing unit 40 after being picked up by the pickup roller 310. The body 10 can include a feed roller 11 configured to deliver the printing medium P picked up by the pickup roller 310 to the developing unit 40 and a feed shaft 12 configured to transfer a rotating force to the feed roller 11.

The pickup unit 30 can include a printing media detection sensor 330 configured to sense the presence of the printing medium P in the printing media storage unit 20 to selectively operate the pickup roller 310. The printing media detection sensor 330 is arranged or configured such that it is substantially parallel to the pickup roller 310 and at a position that is axially above the pickup roller 310. The printing media detection sensor 330 includes an actuator 331 configured to be moved according to the presence of the printing medium P and the number of the printing medium P stacked on the knock-up plate 22, and a sensing unit 332 configured to sense a position of the actuator 331.

The sensing unit 332 can include, for example, an optical sensor consisting of a light emitter 332*a* configured to generate light and a light receiver 332*b* configured to sense the light generated by the light emitter 332*a*. The actuator 331 can have one end rotatably coupled to the feed shaft 12 and the other end disposed between the light emitter 332*a* and the light receiver 332*b* of the sensing unit 332. As the actuator 331 is rotated about the one end coupled to the feed shaft 12, the other end of the actuator 331 can move and be displaced from an original position between the light emitter 332*a* and the light receiver 332*b*. The actuator 331 can include a supporting protrusion 331*a* that is configured to be supported by the printing medium P stacked on the knock-up plate 22. Moreover, the actuator 331 can include a sensing portion 331*b* that is disposed between the light emitter 332*a* and the light receiver 332*b* such that a position of the sensing portion 331*b* is sensed by the sensing unit 332. An operating hole 22*a* can be defined in the knock-up plate 22 into which the supporting protrusion 331*a* can be inserted when all the printing medium P on the knock-up plate 22 is used, that is, when no printing medium P is present or left in the printing media storage unit 20.

Figure 3:
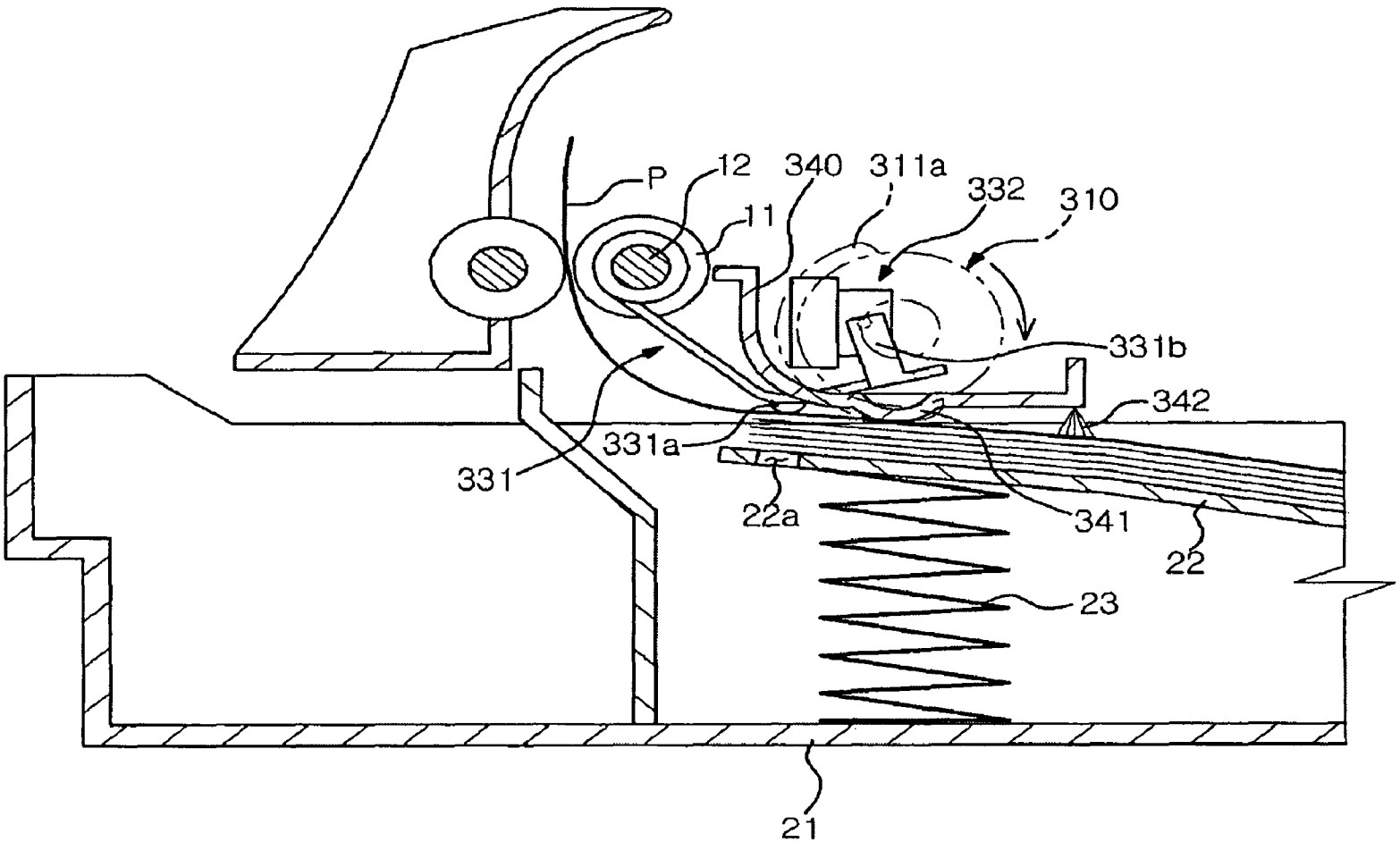
FIGS. 3 and 4 are sectional views illustrating operation of the pickup unit provided in the image forming apparatus according to embodiments of the disclosure.
Figure 4:
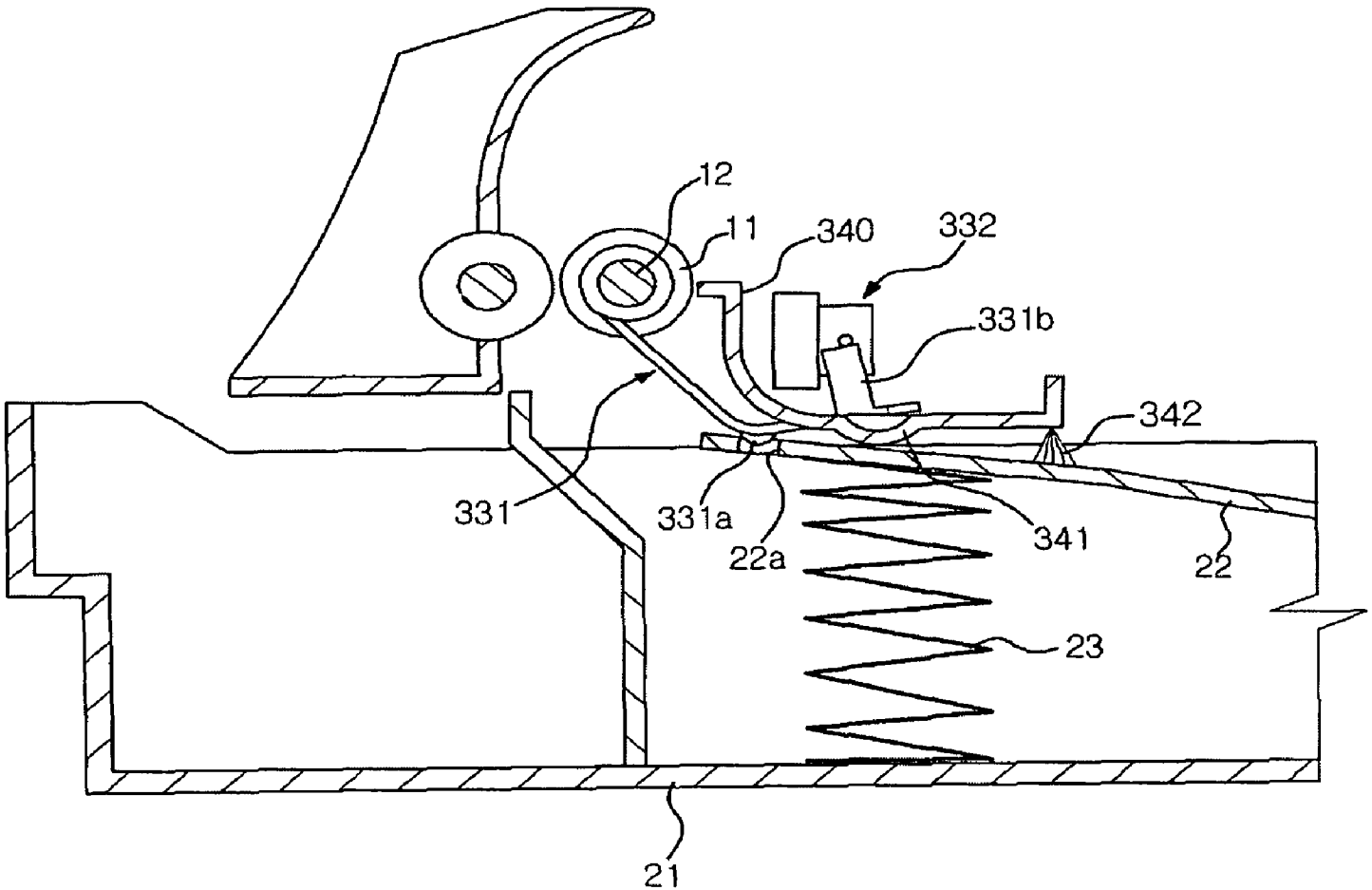

FIG. 3 shows an instance in which the supporting protrusion 331*a* is supported by the printing medium P stacked on the knock-up plate 22 and the sensing portion 331*b* of the actuator 331 is kept at a position between the light emitter 332*a* and the light receiver 332*b*. When all of the printing medium P on the knock-up plate 22 is used, that is, no more printing medium P is left on the knock-up plate 22 (see FIG. 4), the supporting protrusion 331*a* is inserted into the operating hole 22*a*, causing the actuator 331 to be rotated and the sensing portion 331*b* to be moved in a downward direction to become displaced from its original position between the light emitter 332*a* and the light receiver 332*b*. As a result, the light generated from the light emitter 332*a* can reach the light receiver 332*b*, thereby sensing or determining that no printing medium P is present on the knock-up plate 22.

The pickup unit 30 can include a cover 340 configured to prevent foreign matter from entering the above-described sensing unit 332. The cover 340 is positioned to cover the bottom of the sensing unit 332 to prevent, for example, malfunction of the printing media detection sensor 330 that may be caused when foreign matter enters the printing media detection sensor 330 and is deposited between the light emitter 332*a* and the light receiver 332*b*.

In one embodiment, the cover 340 can be disposed below the end of the actuator 331 not rotatably coupled to the feed shaft 12 to allow the actuator 331 to rotate within a limited range. In such embodiment, the supporting protrusion 331*a* of the actuator 331 can be exposed laterally from the cover 340 to be supported by the printing medium P stored in the printing media storage unit 20. The end of the actuator 331 having the sensing portion 331*b* can be located above the cover 340 and is therefore covered by the cover 340. Accordingly, even when the supporting protrusion 331*a* is inserted into the operating hole 22*a*, one end of the actuator 331 is supported by an upper surface of the cover 340, allowing the actuator 331 to be rotated within a limited range.

When the printing medium P is picked up from the printing media storage unit 20 by the pickup unit 30, there is typically some static charge that accumulates on the printing medium P because of the friction that occurs between the printing medium P picked up by the pickup unit 30 and the other printing medium P stored in the printing media storage unit 20. To remove the static charge, the cover 340 can be made of a conductive material and can be electrically grounded by connecting the cover 340 to a ground wire or the like of a power line (not shown) that provides power to the image forming apparatus.

The cover 340 can be disposed in an axial direction of the pickup roller 310 to cover the sensing unit 332 and to be brought into contact with the printing medium picked up by the pickup roller 310.

In one embodiment, the cover 340 has an antistatic portion 341 that protrudes in a downward direction toward the printing medium P to allow the cover 340 to more easily come into contact with the printing medium P. The antistatic portion 341 has a curved contact surface configured to come into contact with the printing medium P without hindering movement of the printing medium P. At a pickup position, that is, where the pickup portion 311*a* comes into contact with the printing medium P, the antistatic portion 341 is located or disposed in an axial direction of the pickup roller 310 having the pickup portion 311*a*.

The cover 340 can further include an antistatic brush 342 to more effectively remove static charge from the printing medium P. Accordingly, the printing medium P is first brought into contact with the antistatic brush 342 for primary removal of static charge and then is brought into contact with the antistatic portion 341 of the cover 340 for secondary or additional removal of static charge.

When the cover 340 is made of a conductive material and is electrically connected to a ground line, the cover 340 can remove static charge from the printing medium P without assistance of a separate antistatic configuration, which can result in a reduction in the size of the image forming apparatus.

Removal of static charge using the cover 340 disposed in an axial direction of the pickup roller 310, as shown in FIG. 3, allows the printing medium P to continuously come into contact with the conductive cover 340 while passing through the pickup roller 310. Therefore, even when the printing medium P is delivered at a high speed for a high-speed printing operation, there is sufficient time to effectively remove static charge from the printing medium P.

Although the embodiments described above exemplify an electro-photographic image forming apparatus, the present invention need not be limited thereto, and can be directly applied to other various kinds of image forming apparatus including an inkjet image forming apparatus.

As is apparent from the above description, an image forming apparatus according to the various embodiments disclosed includes a cover, which is made of a conductive material and is arranged substantially parallel to and in an axial direction of a pickup roller. An effective removal of static charge from the printing medium results when the conductive cover comes into contact with a printing medium that is picked up and delivered by a pickup roller.

Although several embodiments have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising:

a printing media storage unit configured to store printing media;

a pickup unit configured to pick up a printing medium from the printing media stored in the printing media storage unit; and a cover made of a conductive material and adapted to come into contact with the printing medium picked up by the pickup unit; and an antistatic brush coupled to the cover and configured to come into contact with the printing medium.

2. The apparatus according to claim 1, wherein the cover includes a protrusion configured to come into contact with the printing medium.

3. The apparatus according to claim 2, wherein the protrusion of the cover has a curved portion that comes into contact with the printing medium.

4. An image forming apparatus comprising:

a printing media storage unit configured to store printing media;

a pickup unit configured to pick up a printing medium from the printing media stored in the printing media storage unit; and a cover made of a conductive material and adapted to come into contact with the printing medium picked up by the pickup unit, and the cover including a protrusion configured to come into contact with the printing medium, the pickup unit including a pickup roller having a portion of its circumferential region radially protruding to form a pickup portion, and the protrusion of the cover being located in an axial direction of the pickup roller at a pickup position where the pickup portion of the pickup roller comes into contact with the printing medium.

5. An image forming apparatus comprising:

a printing media storage unit configured to store printing media;

a pickup unit configured to pick up a printing medium from the printing media stored in the printing media storage unit; and a cover made of a conductive material and adapted to come into contact with the printing medium picked up by the pickup unit, the pickup unit including a printing media detection sensor configured to sense the presence of the printing media in the printing media storage unit;

the printing media detection sensor including an actuator and a sensing unit, the actuator being configured to be moved according to an amount of the printing media in the printing media storage unit, the sensing unit being configured to sense a position of the actuator, and the cover being positioned to cover the sensing unit.

6. An image forming apparatus comprising:

a printing media storage unit configured to store printing media;

a pickup unit configured to pick up a printing medium from the printing media stored in the printing media storage unit; and a cover made of a conductive material and adapted to come into contact with the printing medium picked up by the pickup unit, the pickup unit including a printing media detection sensor configured to sense the presence of the printing media in the printing media storage unit, the printing media detection sensor including an actuator and a sensing unit, the actuator being configured to be moved according to an amount of the printing media in the printing media storage unit, the sensing unit being configured to sense a position of the actuator, and the cover being configured to limit a movement of the actuator.

7. The apparatus according to claim 6, further comprising:

a feed roller configured to move the printing medium picked up by the pickup unit; and a feed shaft configured to transfer a rotating force to the feed roller, wherein the actuator of the printing media detection sensor has one end rotatably coupled to the feed shaft.

8. The apparatus according to claim 1, wherein the cover is grounded.

9. An image forming apparatus comprising:

a printing media storage unit configured to store printing media;

a pickup unit including a pickup roller, the pick up unit configured to pick up a printing medium from the printing media stored in the printing media storage unit; and a cover made of a conductive material and adapted substantially parallel to the pickup roller in an axial direction of the pickup roller; and an antistatic brush coupled to the cover and configured to come into contact with the printing medium.

10. The apparatus according to claim 9, wherein the cover includes a protrusion configured to come into contact with the printing medium.

11. The apparatus according to claim 10, wherein the protrusion of the cover has a curved portion that comes into contact with the printing medium.

12. An image forming apparatus comprising:

a printing media storage unit configured to store printing media;

a pickup unit including a pickup roller, the pick up unit configured to pick up a printing medium from the printing media stored in the printing media storage unit; and a cover made of a conductive material and adapted substantially parallel to the pickup roller in an axial direction of the pickup roller, the cover including a protrusion configured to come into contact with the printing medium, the pickup roller of the pickup unit having a portion of its circumferential region radially protruding to form a pickup portion, and the protrusion of the cover being located in an axial direction of the pickup roller at a pickup position where the pickup portion of the pickup roller comes into contact with the printing medium.

13. An image forming apparatus comprising:

a printing media storage unit configured to store printing media;

a pickup unit including a pickup roller, the pick up unit configured to pick up a printing medium from the printing media stored in the printing media storage unit; and a cover made of a conductive material and adapted substantially parallel to the pickup roller in an axial direction of the pickup roller, the pickup unit including a printing media detection sensor configured to sense the presence of the printing media in the printing media storage unit;

the printing media detection sensor including an actuator and a sensing unit, the actuator being configured to be moved according to an amount of the printing media in the printing media storage unit, the sensing unit being configured to sense a position of the actuator, and the cover being positioned to cover the sensing unit.

14. An image forming apparatus comprising:

a printing media storage unit configured to store printing media;

a pickup unit including a pickup roller, the pick up unit configured to pick up a printing medium from the printing media stored in the printing media storage unit; and a cover made of a conductive material and adapted substantially parallel to the pickup roller in an axial direction of the pickup roller, the pickup unit including a printing media detection sensor configured to sense the presence of the printing media in the printing media storage unit, the printing media detection sensor including an actuator and a sensing unit, the actuator being configured to be moved according to an amount of the printing media in the printing media storage unit, the sensing unit being configured to sense a position of the actuator, and the cover being configured to limit a movement of the actuator.

15. The apparatus according to claim 14, further comprising:

a feed roller configured to move the printing medium picked up by the pickup unit; and a feed shaft configured to transfer a rotating force to the feed roller, wherein the actuator of the printing media detection sensor has one end rotatably coupled to the feed shaft.

16. The apparatus according to claim 9, wherein the cover is grounded.

17. An image forming apparatus comprising:

a printing media storage unit configured to store printing media;

a pickup unit configured to pick up a printing medium from the printing media stored in the printing media storage unit;

a printing media detection sensor configured to sense the presence of the printing media in the printing media storage unit; and a cover configured to cover the printing media detection sensor, the cover being made of a conductive material and being grounded, wherein the cover includes a protrusion configured to come into contact with the printing medium picked up by the pickup unit.

* * * * *